US005541390A

United States Patent [19]

Pinceloup

[11] Patent Number: 5,541,390

[45] Date of Patent: Jul. 30, 1996

[54] TUNNEL OVEN FOR MICROWAVE HEATING AND COOKING FOODS

[75] Inventor: Didier Pinceloup, Villefranche sur Saone, France

[73] Assignee: Cidelcem Industries, Lognes, France

[21] Appl. No.: 406,524

[22] Filed: Mar. 20, 1995

[51] Int. Cl.[6] ..... H05B 6/78

[52] U.S. Cl. ..... 219/701; 219/682; 219/684; 219/756; 99/DIG. 14; 99/451

[58] Field of Search ..... 219/701, 700, 219/697, 682, 684, 748, 756, 757; 99/DIG. 14, 451

[56] References Cited

U.S. PATENT DOCUMENTS

| | | | |
|---|---|---|---|
| 3,478,900 | 11/1969 | Jeppson | 219/682 |
| 3,704,523 | 12/1972 | Guerga et al. | 219/701 |
| 3,916,137 | 10/1975 | Jurgensen | 219/701 |
| 3,961,568 | 6/1976 | Jeppson | 219/682 |
| 4,246,462 | 1/1981 | Meisel | 219/701 |
| 4,808,782 | 2/1989 | Nakagawa et al. | 219/701 |
| 4,870,236 | 9/1989 | Berggren | 219/697 |
| 4,962,298 | 10/1990 | Ferrari et al. | 219/697 |
| 5,369,250 | 11/1994 | Meredith | 219/748 |

*Primary Examiner*—Philip H. Leung
*Attorney, Agent, or Firm*—Young & Thompson

[57] ABSTRACT

The tunnel oven comprises an elongated enclosure connected to an inlet closure and an outlet closure and traversed by a conveyor transporting the food to be cooked. The enclosure is delimited by a wall forming a floor, a wall forming a ceiling, and two side walls of which one is provided with a door giving access to the interior of the enclosure. The enclosure is divided into several successive cooking chambers separated from each other in the upper portion of the latter, each chamber being associated with several different heaters, including microwave heaters. The microwave heaters of each chamber comprise several sources provided with microwave emission members disposed in the wall forming the ceiling of the chamber such that one microwave emission member will be offset relative to a neighboring microwave emission member, in the direction of advance of the food.

11 Claims, 4 Drawing Sheets

TUNNEL OVEN FOR MICROWAVE HEATING AND COOKING FOODS

BACKGROUND OF THE INVENTION

1. Field of the Invention

The present invention relates to ovens for cooking food for professional use and more particularly tunnel ovens for cooking.

2. Description of the Related Art

There are known tunnel ovens comprising a generally elongated chamber in the form of a parallelepiped of a length of the order of 6 meters which is divided into a succession of cooking chambers. This enclosure is at one of its ends connected to an inlet closure and at the other to an outlet closure.

The intermediate zones between the chamber and the closures conventionally have an incurred shape, the inlet closure being connected to a loading zone, while the outlet closure is connected to a discharge zone for the foods to be cooked.

The loading and discharge zones can be connected in a common handling zone, such that the installation forms an elongated loop which comes together in this handling zone.

These tunnel ovens operate continuously and their capacity is for example about 2500 portions in 7 hours of operation at 250° C., the foodstuffs being during cooking contained in trays disposed on carriages which move through the tunnel on a conveyor.

The tunnel ovens are generally provided with different and complementary heating means so as to accelerate the cooking and to ensure at the same time a good quality of the foods, both as to their nutritional value and as to their appearance.

Thus, the tunnel ovens are preferably provided for simultaneous cooking, mixed or separated in function as to the foods to be cooked, with the aid of microwaves, pulsed air, steam and infrared radiation.

These heating modes are selected as a function of the foods to be cooked and their individual specifications. Thus, microwaves permit above all obtaining the greatest rapidity of cooking, the efficacy of this mode of heating being immediate. Steam heating permits avoiding loss of weight and also permits preserving the organoleptic properties of certain products which otherwise would be changed.

The pulsed air heating conjointly with other heating modes, if desired supplemented by infrared radiation, permits preserving the typical advantages of a conventional type of oven, particularly the possibility of browning and searing the surface of certain products.

Each chamber in the series of chambers acts like an oven and is separated from the following chamber by a deflector suspended from one wall forming the ceiling of the chamber. Each chamber is generally associated with several microwave sources, each source being connected to a microwave generator by means of a waveguide and empties into the interior of the chamber through a microwave emission member in the form of a coupling iris, of an antenna or of a slotted guide.

The microwave emission members within each chamber can be disposed in a side wall of the enclosure or in the wall forming the ceiling of the latter. They are in a known tunnel oven disposed in the ceiling and aligned along a line passing through a transverse plane of the chamber. These microwave emission members should be disposed at a certain distance from each other to avoid interference phenomena, which would result in the microwave emission members not being arranged in an optimum manner relative to the trays.

Each chamber is also associated with a hot air production group comprising a turbine, shielded resistances and a deflector grill. This hot air production group is mounted to one side of the enclosure in the body of the tunnel oven and the deflector grill is integrated into a side wall of the enclosure adjacent the corresponding chamber.

The provision of steam in each chamber is ensured by means of a distribution member in the form of at least one injection nozzle which projects within the chamber and which is connected to an apparatus for steam production.

Finally, the infrared radiation producing elements are constituted by shielded resistances or any other infrared emitter which is suspended in each chamber from the wall forming the ceiling of the enclosure.

SUMMARY OF THE INVENTION

Each heating mode is controlled separately so as to be able to combine as desired with the other heating modes as a function of the foods to be prepared.

The shape of the enclosure as well as the arrangement of the different heating means are moreover extremely important for good heat economy and to obtain a satisfactory result, not only as to the cooking itself but also as to the appearance of the foods.

To permit cleaning the interior of the tunnel oven, the latter is provided with at least one side door pivotally mounted on the body of the tunnel so as to give access simultaneously to several cooking chambers.

The invention has for its object to optimize the power available in each individual chamber and to increase the uniformity of heating.

The invention also has for its object to provide a design for the enclosure having an arrangement better adapted to the size of the trays.

The invention also has for its object to make easier the maintenance of the tunnel.

The invention has for its object a tunnel oven for cooking food, comprising an elongated enclosure connected to an inlet closure and respectively an outlet closure and traversed by a conveyor transporting the foods to be cooked, the enclosure being delimited by a wall forming a bottom, a wall forming a ceiling and two lateral walls of which one is provided with a door giving access to the interior of the enclosure, this enclosure being divided into several successive cooking chambers separated from each other in the upper portion of the latter, each chamber being associated with several different heating means, including microwave means, characterized in that the microwave means of each chamber comprise several applicators provided with microwave emission members disposed in the wall forming the ceiling of the chamber such that a microwave emission member will be offset relative to an adjacent microwave emission member, in the direction of movement of the food.

According to other characteristics of the invention:

- at least two adjacent microwave emission members are disposed along a line which forms an angle with a plane transverse to the chamber;
- the line is parallel to a diagonal of a tray containing the food to be cooked when the tray is located below the microwave emission members;

all the adjacent microwave emission members are aligned with each other;

it comprises at least three microwave emission members disposed in a triangle;

at least the side wall opposite that provided with access doors extends, in a transverse cross section, along a broken line forming obtuse angles alternately projecting outwardly of the enclosure and inwardly toward the interior of the latter;

a projecting angle is disposed in the upper portion of the enclosure and is followed by a re-entrant angle which creates a narrowing in the enclosure, immediately above the trays;

a projecting angle is disposed substantially at the level of the conveyor;

the lateral wall provided with access doors has a shape that is symmetrical relative to the opposite wall;

each chamber is associated with a pulsed hot air production group, and this group is integrated into the access door of the enclosure;

the pulsed hot air production group comprises a turbine, and the air flow is directed substantially toward the central axis of the conveyor;

each chamber is associated with steam distribution means, and the quantity of steam distributed decreases from the first chamber to the last;

the decrease in the quantity of steam is obtained by a decreasing number of steam distribution means from one chamber to the next from the first chamber to the last;

the decrease in the quantity of steam is obtained by a decreasing orifice diameter of the distribution means for the steam from one chamber to the next from the first chamber to the last;

all the steam distribution means are supplied from a single steam generator.

BRIEF DESCRIPTION OF THE DRAWINGS

The invention will now be described in greater detail with respect to a nonlimiting example, with reference to the accompanying drawings, in which.

DETAILED DESCRIPTION OF THE PREFERRED EMBODIMENTS

Figure 1:
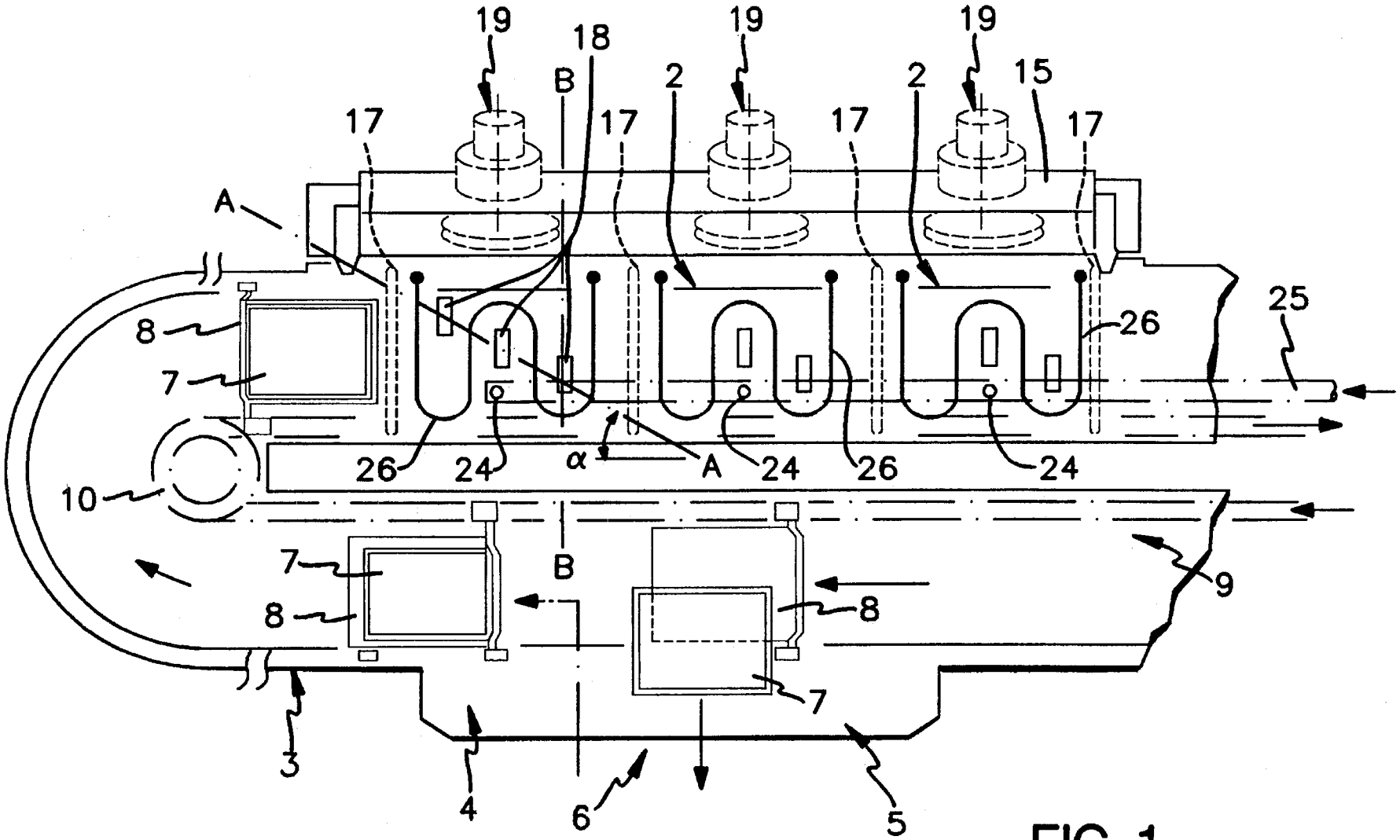
FIG. 1 is a plan view of a tunnel oven according to the invention, with the upper portion removed to show the arrangement of the different elements within the tunnel.

The tunnel oven comprises an elongated enclosure 1 comprised by a series of cooking chambers 2 which will be described in greater detail below.

The ends of the enclosure 1 are connected to an inlet closure 3 and an outlet closure (not shown in the drawings) having the same structure and serving to confine heat energy within the enclosure 1.

The inlet closure 3 and the outlet preferably have an incurved shape, the inlet closure 3 being connected to a loading zone 4, while the outlet closure is connected to a discharge zone 5. The loading and discharge zones 4, 5 connect and together form a handling zone 6. These elements thus form with the enclosure 1 a loop which is closed at the handling zone 6.

This loop arrangement has moreover the advantage of reducing the overall length of the installation which also with this arrangement is relatively large.

The food to be cooked is in a conventional manner contained in trays 7, being disposed on carriages 8 displaced along the rolling track 9 of a conveyor 10 which moves through the inlet closure 3, the enclosure 1 and out the outlet closure.

The trays 7 containing the food are thus driven at a convenient and constant speed while passing through all the successive cooking chambers 2 in a closed loop.

Figure 2:
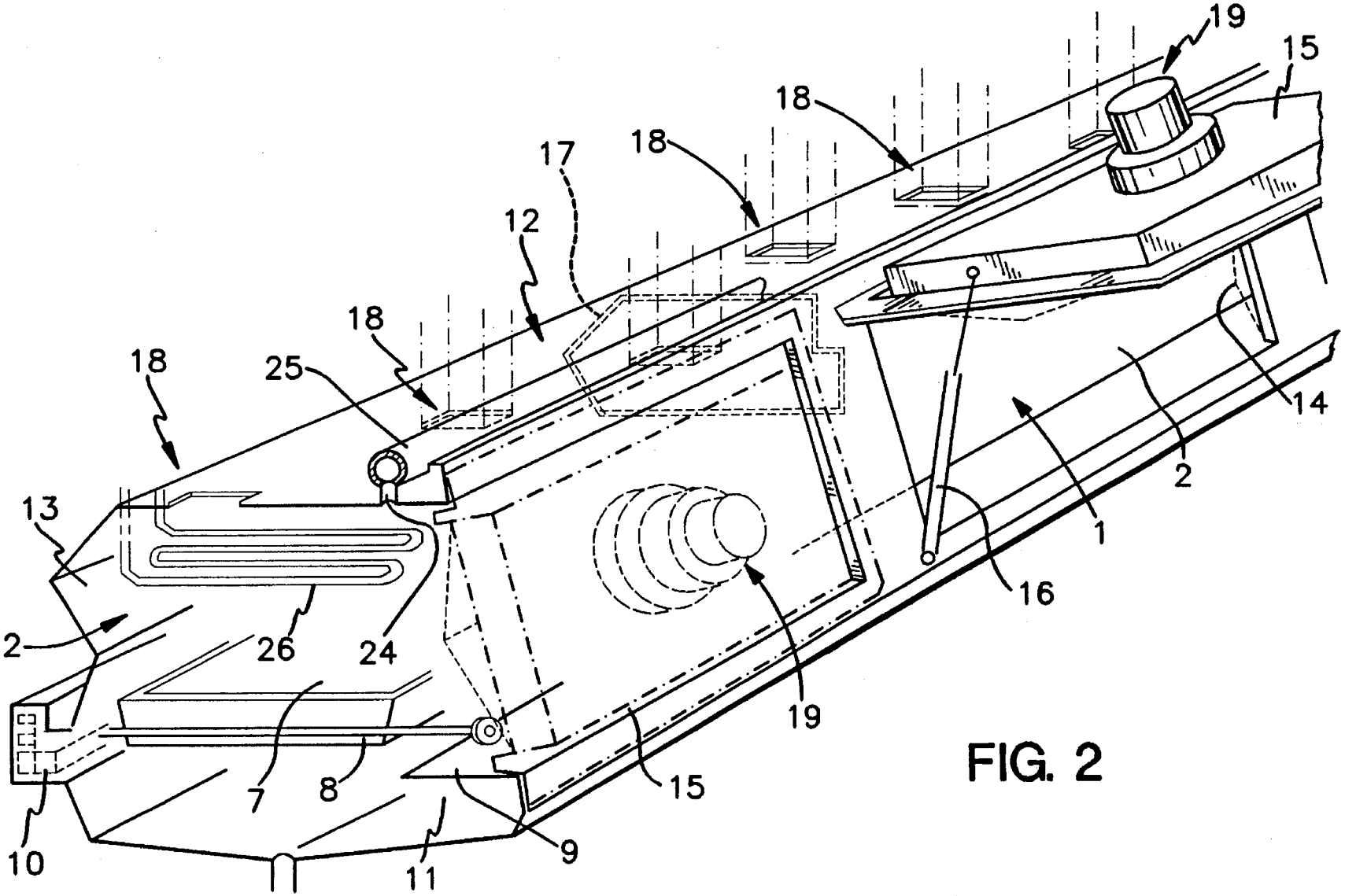
FIG. 2 is a perspective view in cross section showing two cooking chambers of a tunnel oven according to the invention.

The enclosure 1 is laterally delimited, as shown in FIG. 2, by a wall forming a floor 11, a wall forming a ceiling 12 and two side walls 13, 14 of which one, wall 14, is provided with several access doors 15 to the interior of the enclosure 1, in particular for everyday cleaning of the latter.

These access doors 15 are pivotally mounted on the body of the tunnel oven and are preferably controlled by a mechanical system which in FIG. 2 is shown by an electric jack 16.

The number of access doors 15 is a function of the number of cooking chambers 2; an enclosure 1 provided with eight chambers 2 could for example have two access doors 15.

Each cooking chamber 2 is separated from the following chamber 2 by a plate extending vertically from the ceiling 12 and which plate forms a deflector 17. Such a deflector 17 is also disposed upstream of the first chamber 2 so as to separate the latter from the inlet closure 3 and another downstream of the last chamber 2 so as to separate the latter from the outlet closure.

Each cooking chamber 2 is associated with several different heating means. These means permit cooking by microwaves, pulsed air, steam and preferably also infrared radiation.

Thus, each cooking chamber 2 is heated with the aid of several microwave applicators, each applicator being connected to a microwave generator (not shown). This arrangement is not described because it is quite well known per se.

Each microwave applicator comprises a microwave emission member 18 in the form of a coupling iris, an antenna or a slotted guide.

So as to obtain optimum distribution of the microwaves in each individual chamber 2, the microwave emission members 18 are disposed in the wall forming the ceiling 12 of the chamber 2 such that each microwave emission member 18 will be offset relative to a neighboring microwave emission member 18, in the direction of movement of the food or more precisely in the direction of movement of the trays 7 containing the food.

FIG. 1 shows a first arrangement of the microwave emission members 18 according to which these members 18 are disposed along a line A—A which forms an angle $\alpha$ with a transverse plane B—B of the chamber 2.

Figure 4:
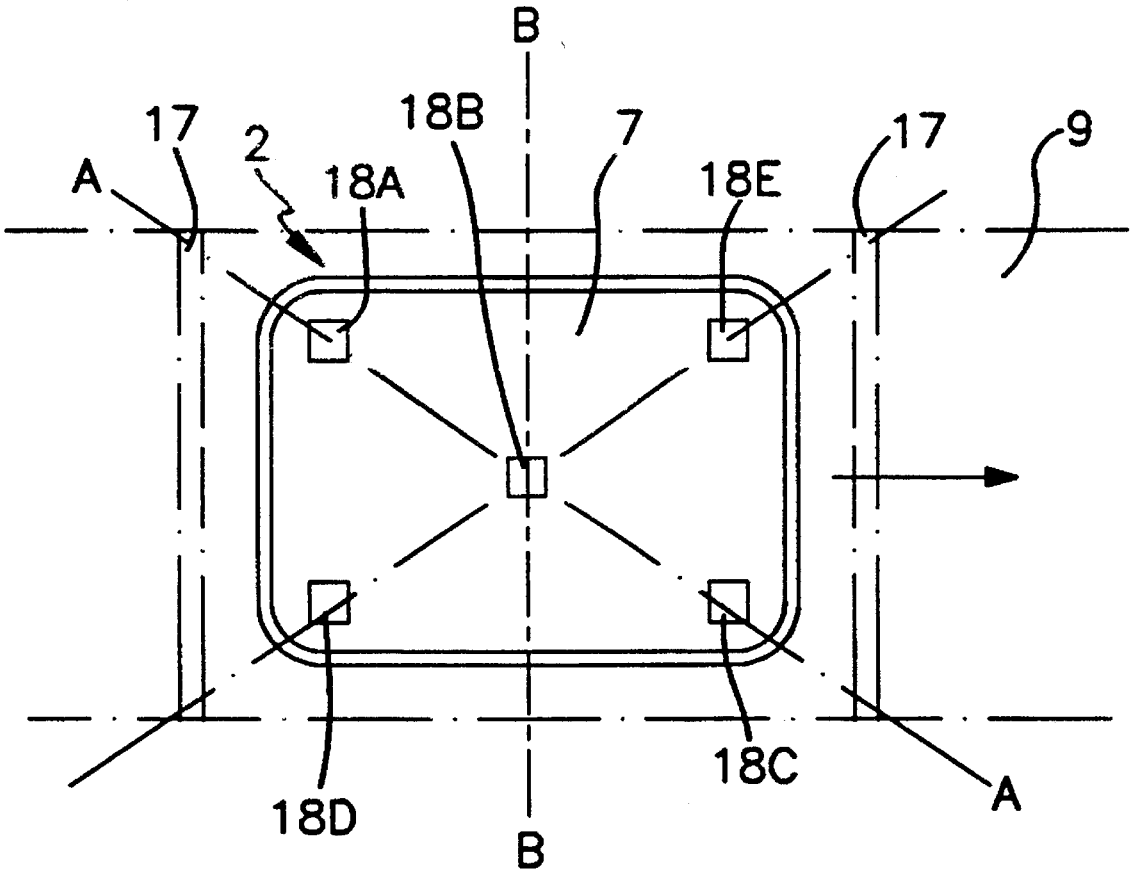
FIG. 4 shows schematically several possibilities for the arrangement of microwave emission members in a cooking chamber.

FIG. 4 associates this first embodiment with microwave emission members 18A, 18B and 18C. This arrangement is equivalent to the arrangement of the applicators 18D, 18B, 18E. FIG. 4 moreover shows several modifications of the arrangement of the microwave emission members 18.

According to a preferred modification, the line A—A along which are disposed the microwave emission members 18 is parallel to the diagonal of a tray 7 containing the foods to be cooked when the tray 7 is located below these microwave emission members 18.

The microwave emission members can 18, when they are three in number, be disposed so as to form a triangle as shown by the arrangement of the microwave emission members 18A, 18B and 18D, or else 18C, 18B and 18E, the apex of this triangle being directed in the direction of movement of the trays 7 respectively or in the opposite direction.

FIG. 4 also shows a modification with five microwave emission members 18A, 18B, 18C, 18D and 1BE of which four are disposed in the regions of the corners of the ceiling 12 of the chamber 2 and one is disposed at the center. Preferably, all the microwave emission members 18 are disposed along lines parallel to the diagonals of the tray 7 when the latter is located in the cooking chamber 2.

Figure 3:
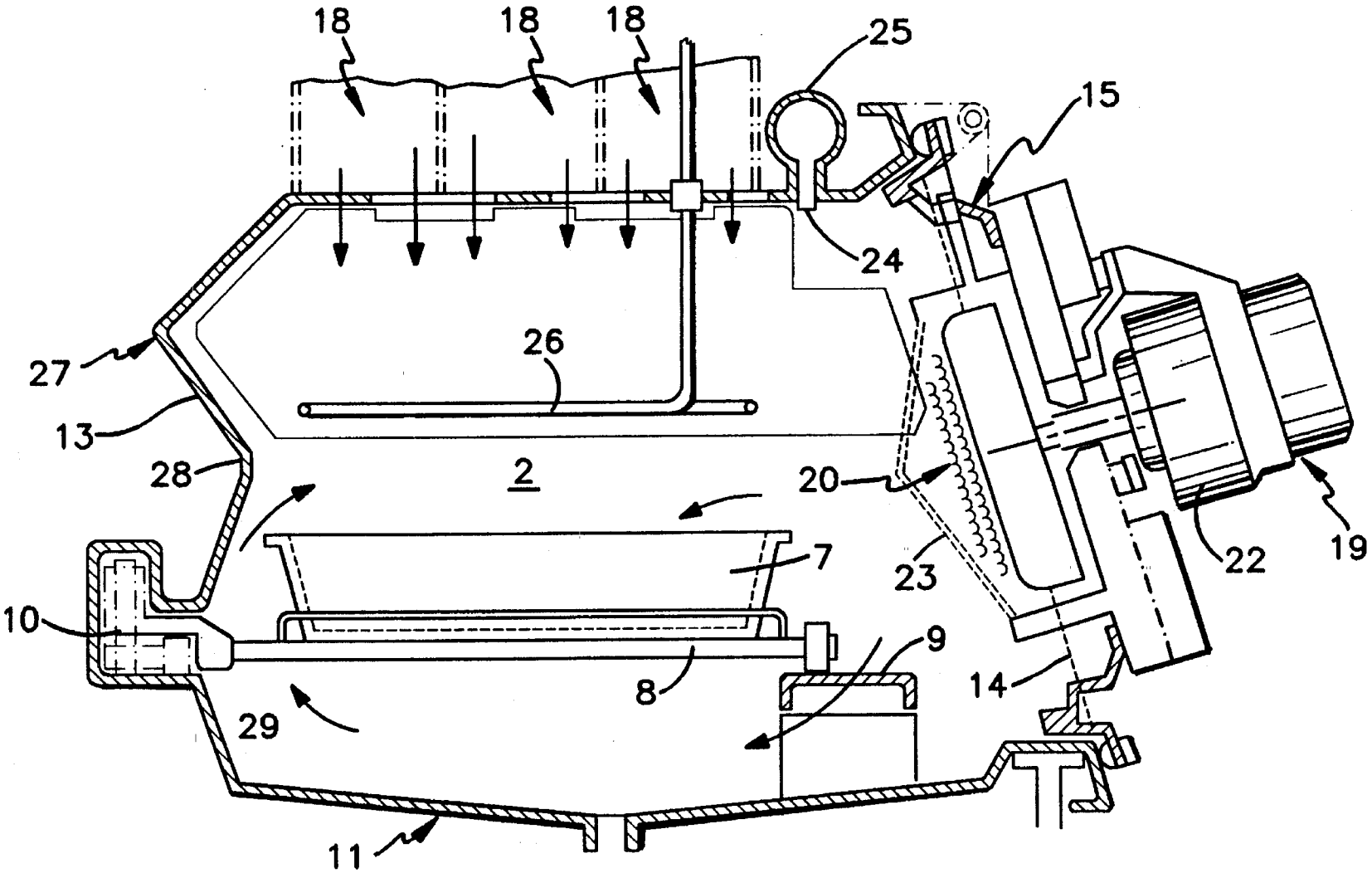
FIG. 3 is a cross-sectional view of a tunnel oven according to the invention.

Each cooking chamber 2 is also associated, as shown in FIG. 3, with a pulsed air production group 19 comprising resistances 20, a turbine 21 driven by an electric motor 22 and a deflector grill 23 directed toward the interior of the chamber 2.

Contrary to the known tunnel ovens in which the pulsed air production groups are disposed in a fixed lateral wall, these groups 19 are according to the invention integrated into the access doors 15 toward the interior of the enclosure 1, which makes them easily accessible for maintenance.

Moreover, the axis of the turbine 21 is directed substantially toward the central axis of the conveyor 10, which ensures that a portion of the pulsed air is directed directly against the food contained in the tray 7, while another portion of the air passes below the tray 7 and is then returned by the opposite side wall of the enclosure. This arrangement has the effect of establishing a continuous hot air circulation around the tray 7.

More generally, and also with other air heating means as for example gas, it is the flow of hot air propelled by the turbine 21 which is directed toward the central axis of the conveyor 10.

Each cooking chamber 2 is moreover associated with steam distribution means in the interior of the chamber 2. These means comprise nozzles 24 opening into the enclosure, with at least one nozzle 24 for each cooking chamber 2.

These nozzles 24 are arranged in the upper portion of the chambers 2, but their placement is not important for the distribution of steam within the corresponding chamber 2.

According to the invention, all nozzles 24 are supplied from a single steam generator (not shown). Steam is led from the generator toward the nozzles 24 by a conduit 25 forming a ramp extending parallel to the enclosure, above the latter.

The quantity of steam distributed in the cooking chambers 2 decreases from the first chamber 2 to the last so as to optimize the efficiency of this manner of heating, the quantity of steam distributed being proportional to the temperature of the foods to be cooked which increases from the inlet toward the outlet of the enclosure.

According to a first modification, this decrease of the quantity of steam distributed in each successive chamber 2 is obtained by a decreasing number of nozzles 24 from one chamber 2 to the next.

According to a second modification, this decrease of the quantity of steam distributed in each successive chamber 2 is obtained by a decreasing diameter of the orifices of the nozzles 24 from one chamber 2 to the next.

It is naturally also possible to combine these two modifications.

So as better to brown and sear the surface of certain products, each chamber 2 can moreover preferably be provided with infrared radiation producing elements constituted by shielded electrical resistances 26 suspended at a suitable height in each chamber 2 from the ceiling 12 of the chamber 12.

So as better to distribute on the one hand the microwaves emitted by the generators and on the other hand to improve the circulation of the hot air propelled by the groups 19 in the chambers 2, at least the side wall 13, opposite the wall 14 provided with the access doors 15, but if desired also this latter wall 14, extends, in a transverse cross section, along a broken line forming obtuse angles alternately projecting outwardly of the enclosure and inwardly of the latter.

Thus, to better distribute the microwaves, such a projecting angle 27 is disposed in the upper portion of the enclosure and is followed by a re-entrant angle 28 which creates a narrowing in the enclosure, immediately above the trays 7.

Another projecting angle 29 is disposed substantially at the level of the conveyor 10, which angle 29 has the effect of improving the circulation of air about the trays 7 driven by the conveyor 10.

The side wall 14 provided with the access doors 15 can preferably have a shape which is symmetrical relative to the opposite side wall 13.

There is thus obtained a tunnel oven in which the thermal efficiency is optimized and whose maintenance is facilitated due to the arrangement of the groups 19 for the production of hot air.

I claim:

1. A tunnel oven for heating food to be cooked in a plurality of trays (7), comprising:

an elongated enclosure (1) having a beginning, an interior, and an end and being defined by a floor (11), a ceiling (12), and two opposite side walls (13, 14);

an inlet closure (3) at the beginning of the enclosure (1);

an outlet closure at the end of the enclosure (1);

conveyor means (10), traversing the enclosure (1), for carrying the plurality of trays (7) containing the food to be cooked;

door means (15), provided in the side wall (14), for giving access to the interior of the enclosure (1);

a plurality of successive cooking chambers (2) separated from each other along the enclosure (1);

a plurality of microwave emission members (18) associated with each of the cooking chambers (2);

wherein the side wall (13) has an outwardly projecting angle (27) disposed in an upper portion thereof and also has an inwardly projecting angle (28) disposed in a middle portion thereof immediately above the plurality of trays (7);

whereby microwaves from the emission members (18) are uniformly distributed to heat the food to be cooked.

2. A tunnel oven, according to claim 1, wherein:

said side wall (13) has another outwardly projecting angle (29) disposed in a lower portion thereof substantially at a level of the conveyor means (10);

whereby circulation of air around the plurality of trays (7) is improved.

3. A tunnel oven, according to claim 1, further comprising:

pulsed air production means (19), mounted in each door means (15), for circulating air around the plurality of trays (7).

4. A tunnel oven, according to claim 3, wherein:

said pulsed air production means (19) includes a turbine means (21) for propelling air substantially towards a central longitudinal axis of the conveyor means (10).

5. A tunnel oven, according to claim 1, wherein:

said microwave emission members (18) are disposed in the ceiling (12) along a line (A—A) parallel to a diagonal of each tray (7) when each tray (7) is located directly below the microwave emission members (18).

6. A tunnel oven, according to claim 1, wherein:

said microwave emission members (18) are disposed in the ceiling (12) in a triangle having an apex pointed in a direction of movement of the plurality of trays (7).

7. A tunnel oven, according to claim 1, wherein:

said microwave emission members (18) are disposed in the ceiling (12) in a triangle having an apex pointed in a direction opposite to a direction of movement of the plurality of trays (7).

8. A tunnel oven, according to claim 1, further comprising:

means (24, 25), associated with each of the cooking chambers (2), for distributing a quantity of steam therein, said quantity of steam being distributed decreasing from a first to a last of the plurality of successive cooking chambers (2).

9. A tunnel oven, according to claim 8, wherein:

said quantity of steam being distributed decreases from the first to the last of the chambers (2) due to a decreasing number of distributing means (24, 25).

10. A tunnel oven, according to claim 8, wherein:

said distributing means (24, 25) have orifices of decreasing diameter from the first to the last of the chambers (2) so that the quantity of steam being distributed decreases along the successive cooking chambers (2).

11. A tunnel oven, according to claim 8, further comprising:

a single generator means for supplying the quantity of steam to the distributing means (24, 25).

* * * * *